US008910330B1

(12) United States Patent
Malik

(10) Patent No.: US 8,910,330 B1
(45) Date of Patent: Dec. 16, 2014

(54) CUDDLING PILLOW

(71) Applicant: Suvin Malik, New York, NY (US)

(72) Inventor: Suvin Malik, New York, NY (US)

(73) Assignee: EZ Cuddle, LLC, New York, NY (US)

( * ) Notice: Subject to any disclaimer, the term of this patent is extended or adjusted under 35 U.S.C. 154(b) by 0 days.

(21) Appl. No.: 13/893,416

(22) Filed: May 14, 2013

(51) Int. Cl.
*A47C 20/00* (2006.01)
*A47G 9/10* (2006.01)

(52) U.S. Cl.
CPC ..... *A47G 9/10* (2013.01)
USPC ..... 5/636; 5/646

(58) Field of Classification Search
CPC ..... A47G 9/10; A47G 9/1081; A47G 9/1054; A47G 9/1045; A47G 9/1009; A47G 2009/1018
USPC ..... 5/636, 646
See application file for complete search history.

(56) References Cited

U.S. PATENT DOCUMENTS

| | | | | |
|---|---|---|---|---|
| 3,757,364 | A * | 9/1973 | Downing | 5/636 |
| 5,644,809 | A * | 7/1997 | Olson | 5/636 |
| 6,336,236 | B1 * | 1/2002 | Dalton | 5/636 |
| D471,050 | S | 3/2003 | Haubner | |
| 6,574,809 | B1 * | 6/2003 | Rathbun | 5/636 |
| D484,727 | S | 1/2004 | Haywood | |
| 6,671,907 | B1 | 1/2004 | Zuberi | |
| D502,038 | S | 2/2005 | Berke et al. | |
| 7,216,387 | B2 | 5/2007 | Laxton | |
| 7,228,580 | B2 * | 6/2007 | Dalton | 5/636 |
| D552,244 | S | 10/2007 | Tinsley | |
| D592,753 | S | 5/2009 | Jacinto | |
| D613,987 | S | 4/2010 | Heeter | |
| D628,298 | S | 11/2010 | Rubio | |
| D636,212 | S | 4/2011 | Carlucci et al. | |
| 2001/0029630 | A1 * | 10/2001 | Cortese et al. | 5/636 |
| 2005/0223493 | A1 * | 10/2005 | Setokawa et al. | 5/636 |
| 2013/0232692 | A1 * | 9/2013 | Sung | 5/636 |

* cited by examiner

*Primary Examiner* — Robert G Santos
*Assistant Examiner* — Richard G Davis
(74) *Attorney, Agent, or Firm* — Manelli Selter PLLC; Edward J. Stemberger

(57) ABSTRACT

A pillow of embodiments of the disclosed technology has a top side and bottom side. The bottom side has a front support at the front, and back portion extending along the length of the back. The front support and back portion are adapted to touch a surface on which they rest, leaving a cavity between the back portion all the way to the front of the pillow, excluding the front support. As such, the pillow is almost entirely open at the front, the only portion at the front lacking an opening is for the centrally located front support. Two such pillows may be placed together, allowing one to extend his/her arm into the cavity and under an adjacent pillow for comfort when lying next to another person, one person resting on the first pillow, and another on the second pillow, with an arm of one person under both pillows.

12 Claims, 15 Drawing Sheets

CUDDLING PILLOW

BACKGROUND OF THE DISCLOSED TECHNOLOGY

The problem of two persons lying next to another, without having a place for the two pairs of arms attached to their torsos, is known in the art. In fact, the issue is even joked about in the XKCD comic available, at the time of this writing, at http://xkcd.com/335. In the comic, a mattress is designed which allows the two parties to stick their arms through a hole in the mattress. Then, in a further pane of the comic, the parties are able to play a game with their arms extending through the hole in the mattress.

While not as humorous, in addition to mattresses, pillows with passageways for the arms are also known in the art. For example, U.S. Pat. No. 6,671,907 to Zubari discloses a pillow with two passageways passing through from one narrow side to the other. U.S. Patent to Shaffer U.S. Pat. No. 6,128,797 is for a face-down tanning and massage pad made of an inflatable plastic or rubber material or solid foam material with a center opening and ventilation for holding a person's head in a downward position. U.S. Pat. No. 4,118,813 to Armstrong discloses a sleep training pillow for the prevention of snoring and is designed to train a person to sleep in a position which prevents snoring. The pillow has a pillow-support surface and a face-support surface. The face-support surface is inclined downward from a high end to a low end, and a relief cavity is cut out near the low end of the pillow. U.S. Pat. No. 5,579,551 to Tommaney discloses an arch-shape pillow apparatus provided with an ear accommodation. Hartunian, in U.S. Pat. No. 5,269,035, shows a head support for a person lying in a prone position, which supports the patient's head at the chin and forehead and includes a side opening for an anesthetist to view a patient's face for passage of an endotracheal or other tube used during surgery. Treace, in U.S. Pat. No. 3,694,831 shows a medical head-support for a variety of uses in hospitals. The pillow has two inwardly angled portions, along with a cutout and a hole to position the head facing upward, or downward, or to one side. Further, a variety of U.S. Design Patents (D471050, D636,212, D613,987) and others, as referenced in the Information Disclosure Statement for this patent application, shows various pillow designs.

SUMMARY OF THE DISCLOSED TECHNOLOGY

Two pillows, each having a top, bottom, front side, back side, and longitudinal sides, the longitudinal sides extending between a respective said front and back side, and at least one pillow of the two pillows pillow further have a generally planar top side, front portion extending to each of the longitudinal sides of the pillow, and a a back support at the back side of the pillow. The front portion and the back support extend downwards from the generally planar top side, forming a longitudinal cavity extending between the longitudinal sides of the pillow. Such pillows may be identical such that when aligned in a transverse fashion, with front portion of one pillow aligned with a back portion of another pillow and sides placed adjacent or abutting each other, a diagonal cavity is formed, continuously between them (which may include, for purposes of this disclosure, a space between the pillows but still be considered "continuous"). The pillows may be identical, substantially identical (defined as, "being the same pillow type and style, according to an ordinary observer"), and may have identical heights. A top side of the pillow or pillow may have a longitudinal cavity lower than all portions of the top side which are above the back and front supported sections thereof.

Each pillow, or a single pillow of an embodiment of the disclosed technology, may be defined by a top, right, left, bottom, front and back side, the top side extending between the right, left, front, and back sides. The bottom side may be defined by a back post support at the back side and a front portion at the front side, wherein the back post support is centered between the left and right side, and the front portion extends from the left to said right side, such that the bottom side is adapted to rest on a surface touching only the front side, between and including the left and right side thereof, and the back post support. A longitudinal cavity is formed between a rear-most extent of the front portion and the back side, excluding a position of The back post support, such that a portion of the cavity is open at the left and right side and the back side at two places, bisected by the back post support.

The front portion may extend no more than 10%, 20%, 30%, 34%, or 40% of a length from the front side to the back side of the pillow. The longitudinal cavity extends 100% of the distance between the left and right sides and at least 40%, 60%, 70%, or 90% of the distance from the back side to the front side, exclusive of the back post support.

The pillow may be used by resting one's head on the top side of said pillow, pushing one's arm into the longitudinal cavity until at least part of the arm is under a top side of the pillow, and removing one's arm from the longitudinal cavity by displacing a flexible back support post, the support post supporting the pillow on a surface. Further, one may place his or her arm on a person, such a person resting his or her head on the pillow. A flexible back support post may be displaced for an arm to enter the longitudinal cavity.

When using two pillows, one pillow may be substantially a solid rectangular prism. ("Substantially" is defined as "according to an ordinary observer", in this case, what an ordinary person would call a "rectangular pillow").

In one embodiment of the disclosed technology, two pillows are used. Each pillow may be identical to the other (identical is defined as "what an ordinary observer would consider to be the same"), each having a top, bottom, front side, back side, and longitudinal sides. The longitudinal sides (left and right sides) extend between a respective front and back side. Each pillow further has a generally planar top side. ("Generally" for purposes of this disclosure, is defined as a modifier which is within 90% of "completely and totally" and/or "what an ordinary observer would consider to be the same"). A back portion extends to each of the longitudinal sides of the pillow, and a front support is at the front side of the pillow. The back portion and the front support extend downwards from the generally planar top side, forming a longitudinal cavity extending between the longitudinal sides of the pillow.

The pillows are placed, in embodiments of the disclosed technology, such that two longitudinal sides (one from each pillow) are adjacent (defined as, "the majority or at least 90% of one pillow being aligned with the majority or at least 90% of the other pillow") to one another. As such, a continuous (which may include a space open at the top, between the pillows), non-obstructed channel is formed extending between the pillows, underneath the generally planar surface of the pillows. The pillows may have identical heights and may be slanted downward, from the back side to the front side.

A method of using two pillows, such as the pillows described above, has the steps of resting a head on a first pillow of the two pillows, extending an arm beneath the top side of the first pillow, and further extending the arm into the longitudinal cavity of the second pillow. In this method of use, one extends his/her arm under (at) the front side of the first pillow, between the front support and a longitudinal side adjacent to the second pillow, or between the front supports of each pillow. One may also optionally rest his/her other arm on a person whose head is on the second pillow.

A pillow of embodiments of the disclosed technology, has top, right, left, bottom, front and back sides. The top side of this pillow extends between the right and left, and front and back, sides. The bottom side is defined by (that is, extending to and incorporating) a front support at the front side and a back portion at the back side, where the front support is centered between the left and right sides, and the back portion extends from the left to the right side, such that the bottom side is adapted to rest on a surface touching only the back side and the front support. Further, a longitudinal cavity is formed between a front-most extent of the back portion and the front side, excluding a position of the front support, such that the cavity is open at the left and right side at one place and the front side at two places, the front side being bisected by the front support.

The above pillow may be two pillows arranged such that the longitudinal cavity of each first and second pillow forms a continuous cavity when the left or right side of a first said pillow abuts the right or left side of the second pillow. That is, there is a right/left combination, one from each pillow, and the pillows abut each other.

The back portion extends no more than 5%, 10%, 20%, 25%, or 35% of a length from the back side to the front side of the pillow, depending on embodiment. Meanwhile, the longitudinal cavity extends 100% of the distance between the left and right sides and at least 40%, 50%, 60%, 70%, or 80% of the distance from the back side to the front side, exclusive of the front support.

A method of using such a pillow may be carried out by abutting a left or right side of the pillow to a right or left side of the second pillow, resting one's head on the top side of the pillow, and pushing one's arm into the longitudinal cavity and continuing until at least part of this arm is under a top side of the second pillow. A second person may rest his/her head on the second pillow, and the first person may place his/her arm on this second person.

DETAILED DESCRIPTION OF EMBODIMENTS OF THE DISCLOSED TECHNOLOGY

The disclosed technology is a pillow device with arm passageway and method of use. A pillow of embodiments of the disclosed technology has a top, right, left, bottom, front and back sides. The front side, back side, left side and right side each define a peripheral edge of the pillow. The top side of this pillow extends between the right and left, and front and back, sides. The bottom side is defined by (that is, extending to and incorporating) a front support at the front side and back portion at the back side, where the front support is centered between the left and right sides and the back portion extends from the left to the right side, such that the bottom side is adapted to rest on a surface touching only the back side and the front support. Further, a longitudinal cavity is formed between a front-most extend of the back portion and the front side, excluding a position of the front support, such that the cavity is open at the left and right sides at one place and the front side at two places, the front side be bisected by the front support.

The above pillow may be two pillows arranged such that the longitudinal cavity of each first and second pillow forms a continuous cavity when the left or right side of a first said pillow abuts the right or left side of the second pillow. That is, there is a right/left combination, one from each pillow, with the pillows abutting each other.

Embodiments of the disclosed technology will become clearer in view of the following description of the figures.

Figure 1:
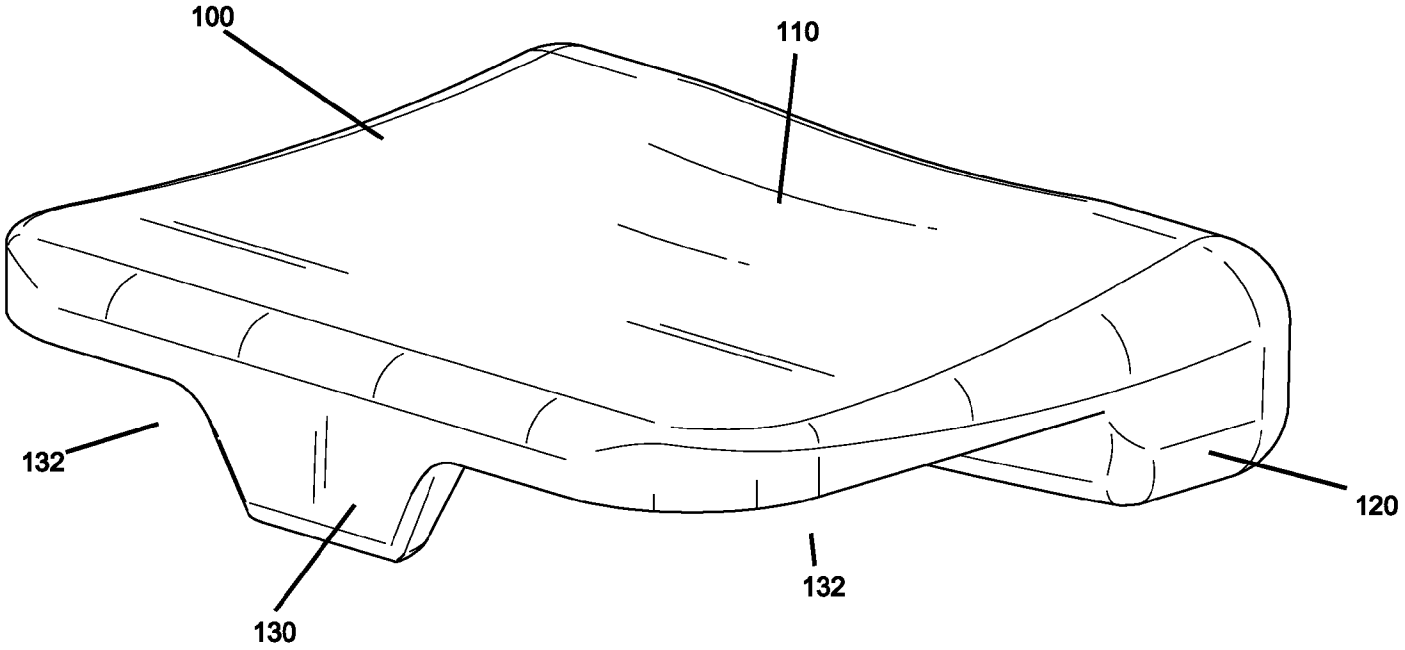
FIG. 1 shows a top perspective view of a pillow with front support and longitudinal arm passageway of an embodiment of the disclosed technology.

FIG. 1 shows a top perspective view of a pillow with back post support and longitudinal arm passageway of an embodiment of the disclosed technology. A pillow 100 has a top portion 110 which defines the upper side of the pillow and may be of a standard size known in the art, such that the pillow fits into pillow cases generally found in the marketplace. A front support portion 120 forms a unitary structure with the top portion 110 and extends longitudinally across the pillow as shown in the figures, with the longitudinal side being defined by the longest direction of the front support portion 120. A rear or back support post 130 supports the pillow at the back side, defined by the position of the back support post 130 relative to the front support portion.

Figure 2:
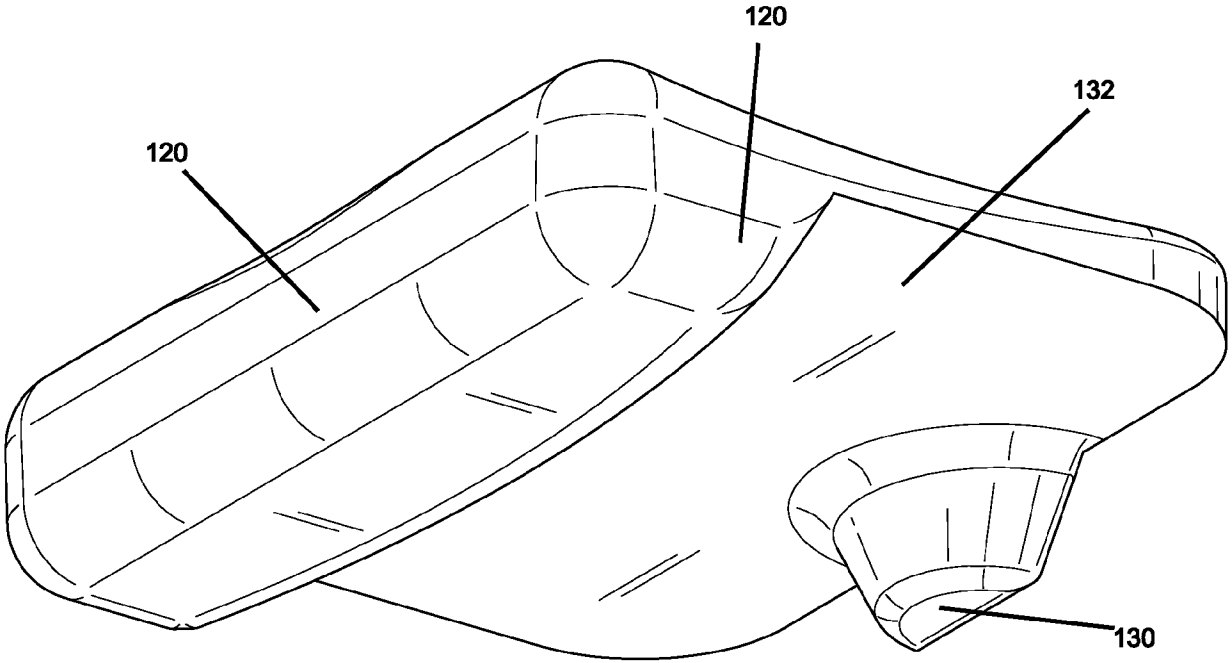
FIG. 2 shows a bottom perspective view of the pillow of FIG. 1.

FIG. 2 shows a bottom perspective view of the pillow of FIG. 1. Here, the back support post 130 is more clearly seen, leaving open a passageway which extends longitudinally from one side of the pillow to the other. The passageway is further open to each back corner of the pillow. As such, an arm may enter diagonally or straight into the side of the pillow, and an arm of a user may pass through this passageway, starting at a back side, at either side of the post 130, and extend longitudinally or diagonally through the pillow and, optionally, out of a side thereof.

Figure 3:
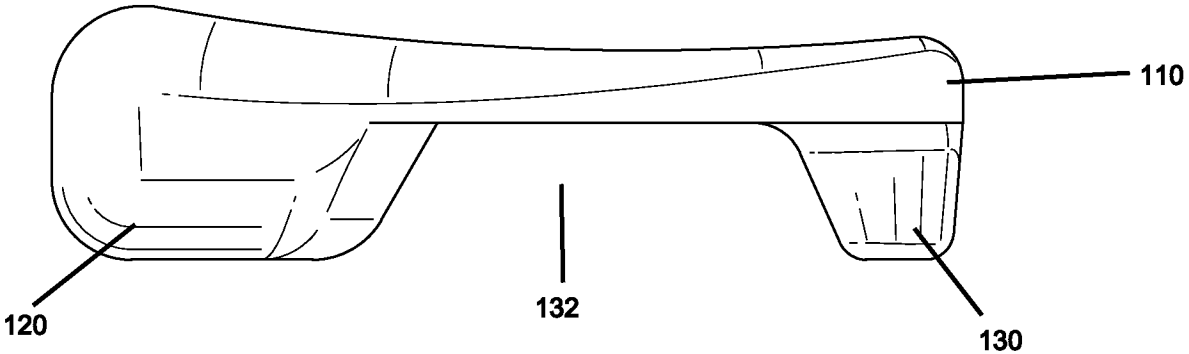
FIG. 3 shows a side elevation view of the pillow of FIG. 1, the opposite side being a mirror image thereof.

FIG. 3 shows a side elevation view of the pillow of FIG. 1, the opposite side being a mirror image thereof. Note the passageway 132 which opens to each side, creating a completely longitudinal pathway for an arm therein. The corners at the back side of the pillow (near label 110 and 130, with label 120 being at the front side) also open into the longitudinal cavity. The pillow surface and top portion 110 is supported by the front portion 120 and rear post support 130, the rear post support being in the middle of the pillow, allowing one a range of motion of the arm in the pillow, through the back or side thereof.

Figure 4:
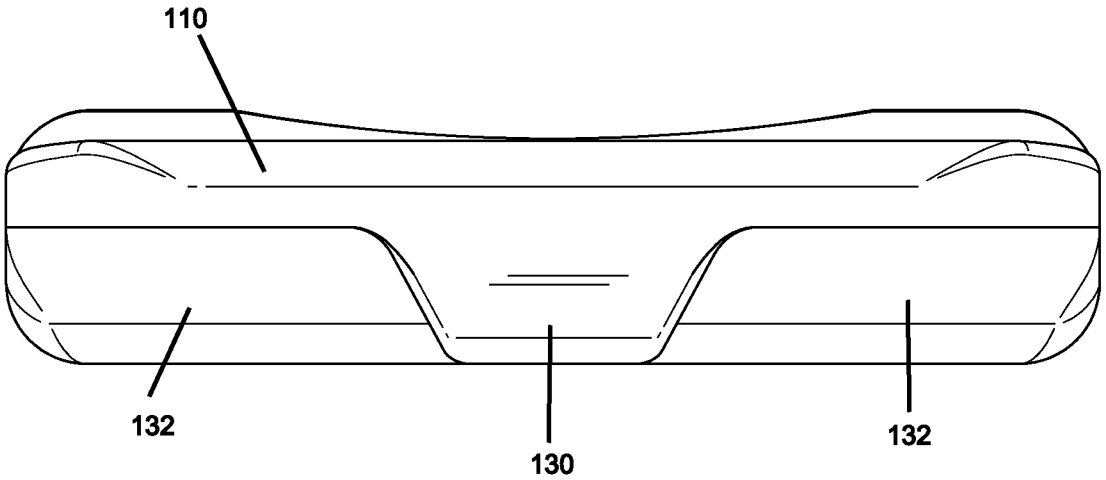
FIG. 4 shows a front elevation view of the pillow of FIG. 1.

FIG. 4 shows a back elevation view of the pillow of FIG. 1. Here, the back support post 130 appears to bisect the longitudinal channel 132 extending along the length of the pillow. An arm may enter the passageway 132 on either side of the front post 130 and exit out the side of the passageway on either side, including the corners of the passageway.

Figure 5:
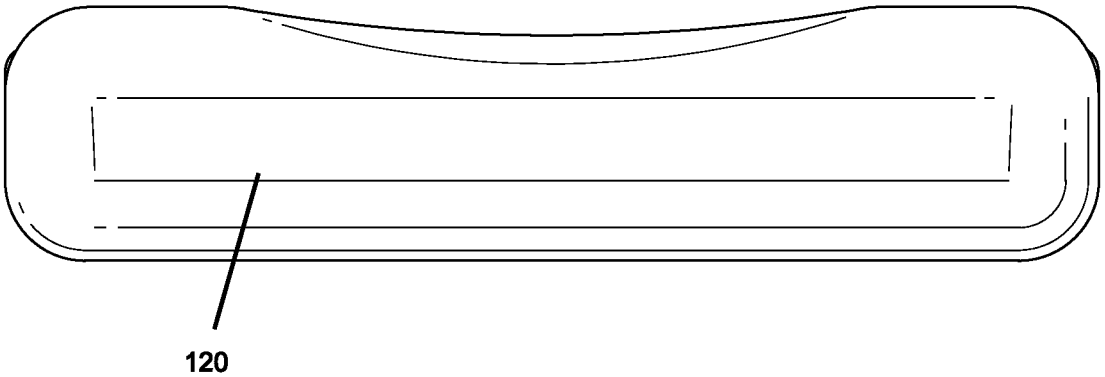
FIG. 5 shows a back elevation view of the pillow of FIG. 1.

FIG. 5 shows a front elevation view of the pillow of FIG. 1. From the front, the front support portion 120 is shown, extending along the entire height of the device.

Figure 6:
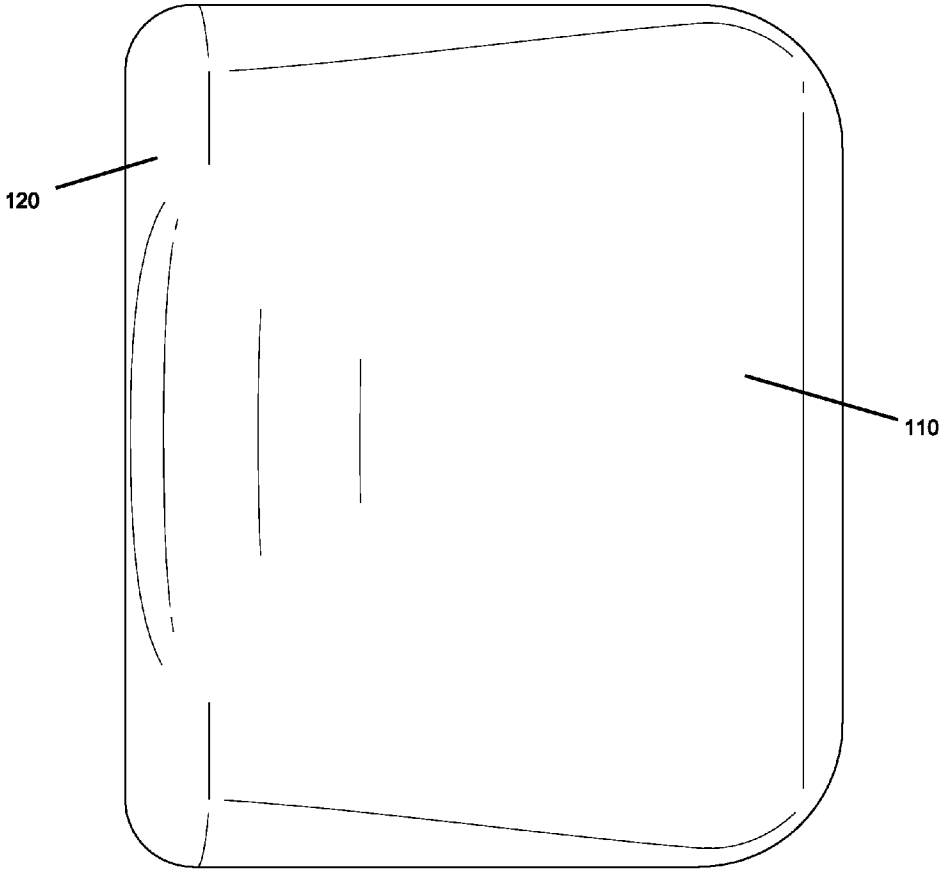
FIG. 6 shows a top view of the pillow of FIG. 1.

FIG. 6 shows a top view of the pillow of FIG. 1. In this top view, the pillow appears to be an ordinary pillow known in the prior art, and functions similarly. However, the longitudinal passageway is hidden there-beneath.

Figure 7:
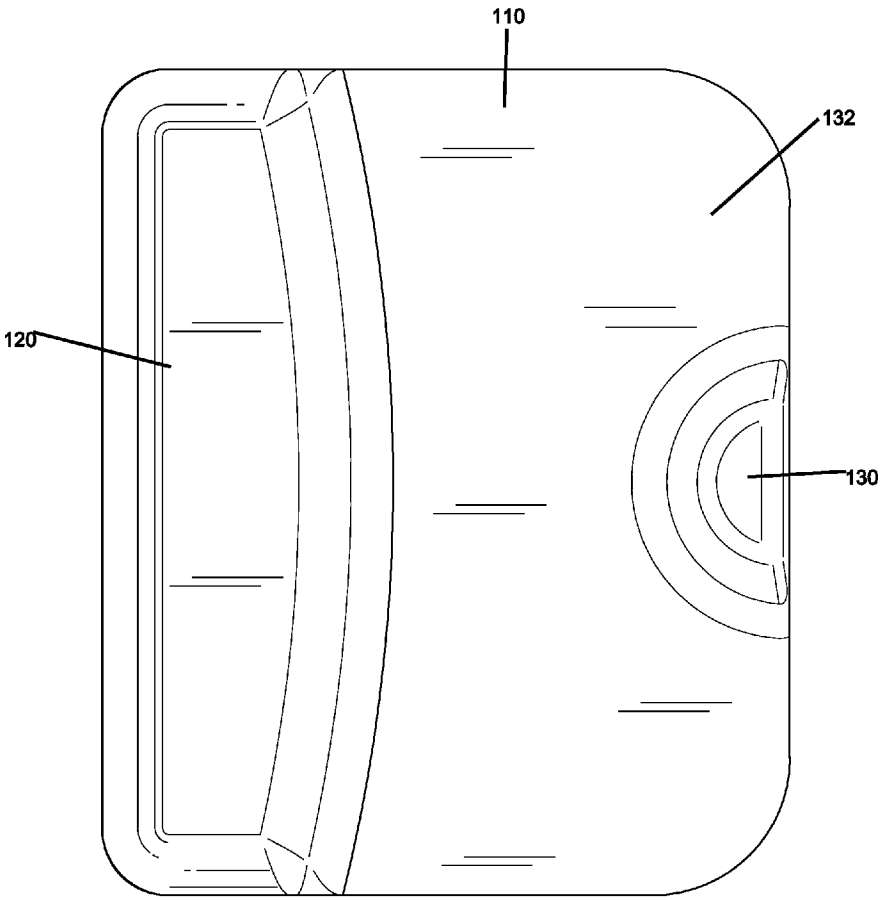
FIG. 7 shows a bottom view of the pillow of FIG. 1.

FIG. 7 shows a bottom view of the pillow of FIG. 1. Here, the bottom side of the top portion 110 is shown to the right of the front support portion 120. The back post support 130 is shown on the right side, with the passageway defined by the area between the front support portion 120 and back support portion 130 which is under the top portion 110. Here, one can pass his/her arm between a bottom surface, such as a bed, which the pillow rests on, and the pillow. The arm then extends between the back support post 130 and front portion 120.

While the head rests on top of the pillow (on the top side of the top portion 110), the arm (including "hand" and "wrist," for purposes of this disclosure) of the user may exit from the passageway area 132 in two places. A first location is at a front corner (meaning, that the arm passes between a geometric front corner of the device), and the second location is a side of the pillow (exiting at the top or bottom of the page, as shown in FIG. 7), in an embodiment. In another embodiment, the first location is at a back side (meaning that the arm passes between a back or rear lip (the back-most side) of the pillow and the surface (such as a bed) directly beneath. The second location is again at a side of the pillow, that is, at a side lip (a furthest extent of the side of the device).

Figure 8:
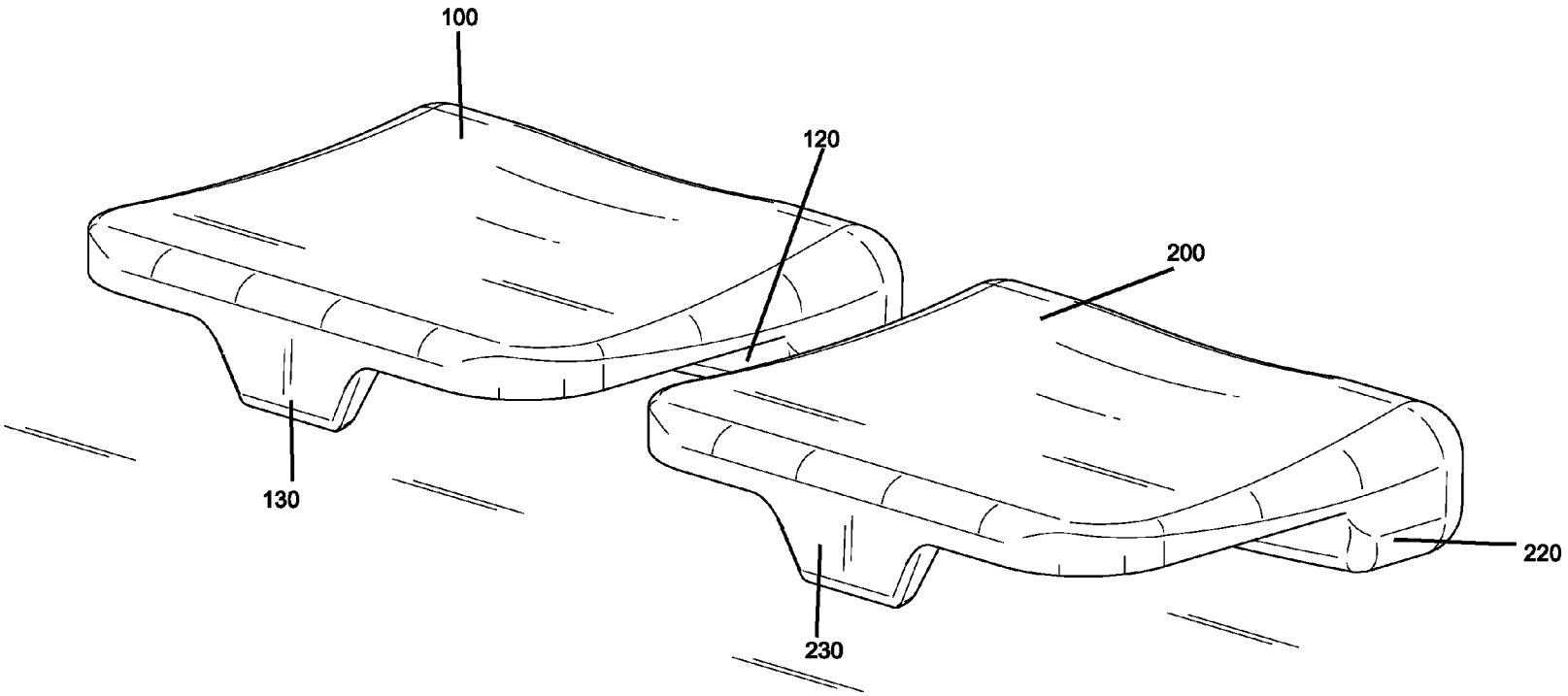
FIG. 8 shows a top perspective view of two pillows of FIG. 1 positioned side by side, with a continuous passageway created.

FIG. 8 shows a top perspective view of two pillows of FIG. 1 positioned side by side, with a continuous passageway created. Here, pillow 200 is identical to pillow 100. The elements of pillow 200 have been incremented by 100 above the elements of pillow 100. A side of pillow 100 is placed next to (within six inches or touching) an adjacent, but opposite side of pillow 200. As such, the sides of the pillows, defined by the exterior extent extending from the front to the back of each pillow, are adjacent. When viewed from the bottom, it will be seen that this causes the longitudinal channels of each pillow to lack obstruction between the pillows.

Figure 9:
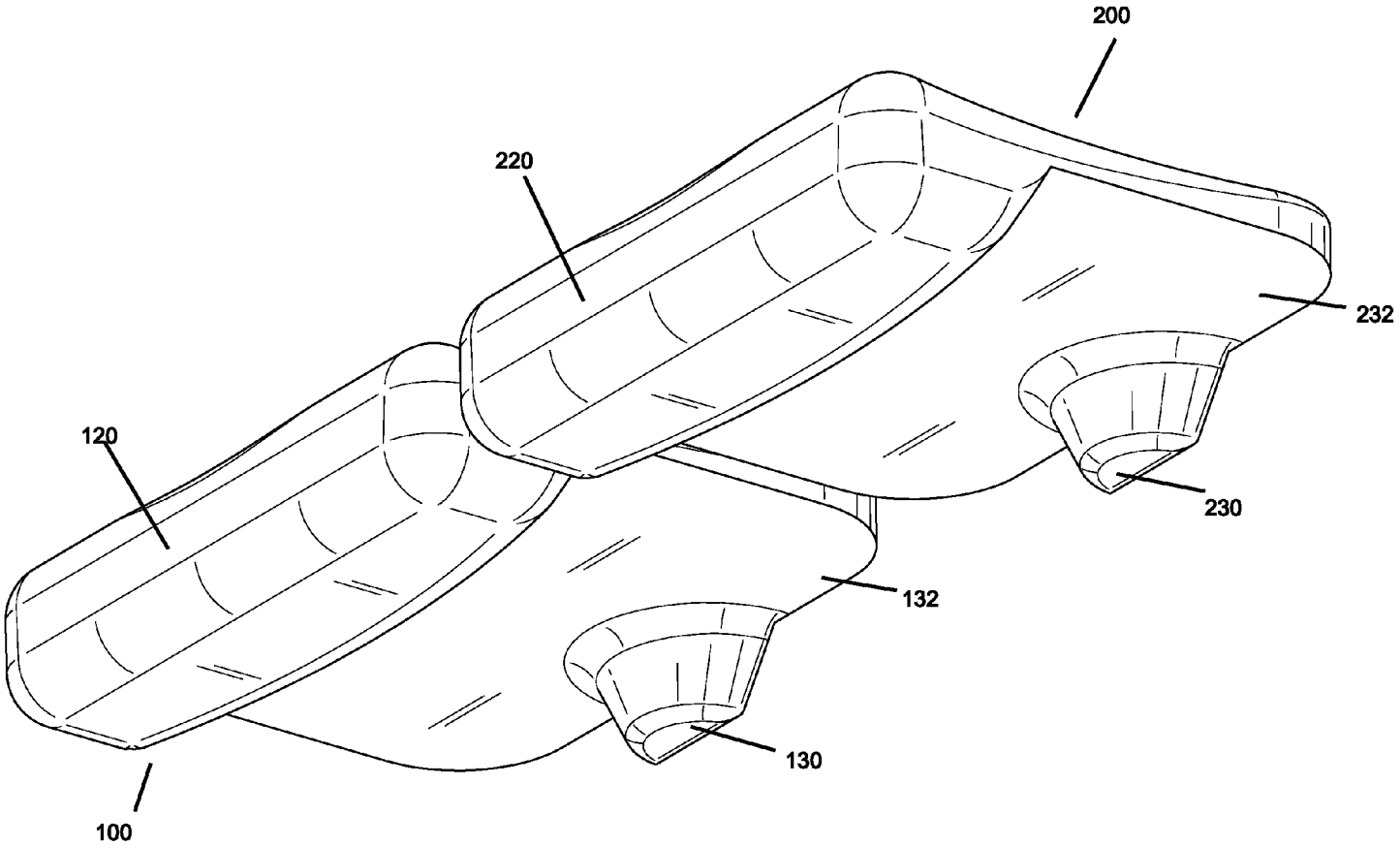
FIG. 9 shows a bottom perspective view of the two pillows of FIG. 8.

FIG. 9 shows a bottom perspective view of the two pillows of FIG. 8. Note that the longitudinal channels 132 and 232 join, such that an arm of a user of one of the pillows may extend it under his/her own pillow, and, additionally and simultaneously, under that of the neighboring pillow. For example, a wife may lay her head on pillow 100 by placing her head on the top 1100 of the pillow (see FIG. 6, for example) at the back side, directly above the back support post 130 or corner 132. A husband may lay his head on pillow 200 by placing his head on the top 210 of the pillow at the back side, directly above the back support post 230. The husband may then reach his arm in the space 232 under the top of the pillow 200, and extend his arm under the pillow 100 (in the space 132). In this manner, with the adjacent pillows and continuous longitudinal channel (defined as unobstructed between channels of two pillows), the couple can abut each other while having a place for the arm or arms that are between their torsos.

Figure 10:
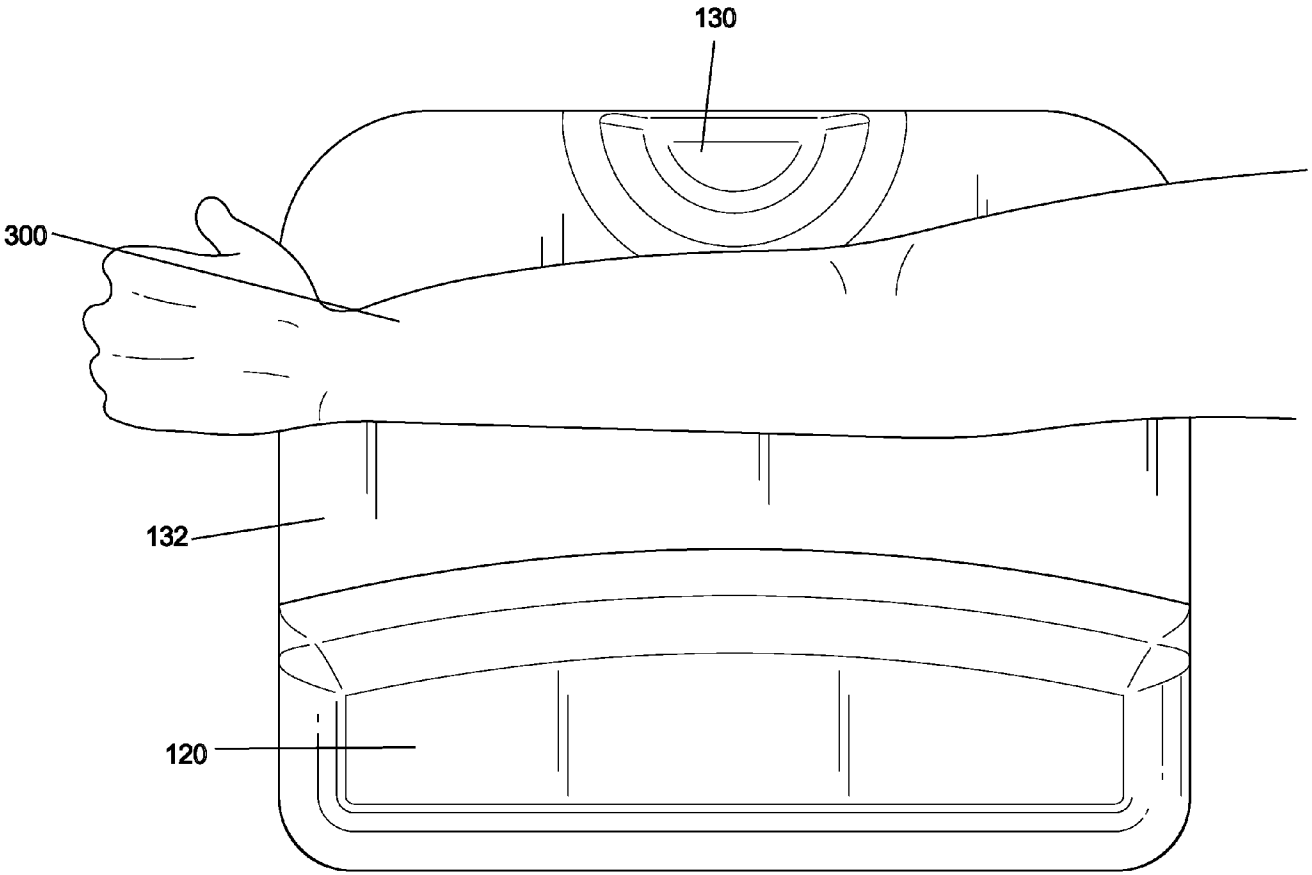
FIG. 10 shows an underside of a pillow of embodiments of the disclosed technology, with position of an arm of a user thereof.

FIG. 10 shows an underside of a pillow of embodiments of the disclosed technology, with position of an arm of a user thereof. The arm 300 passes through the cavity 132 situated between the back support post 130 and front 120, in embodiments of the disclosed technology. This allows one to have an arm extending partially or completely under a pillow with one's head, or someone else's head, on top of the pillow.

Figure 11:
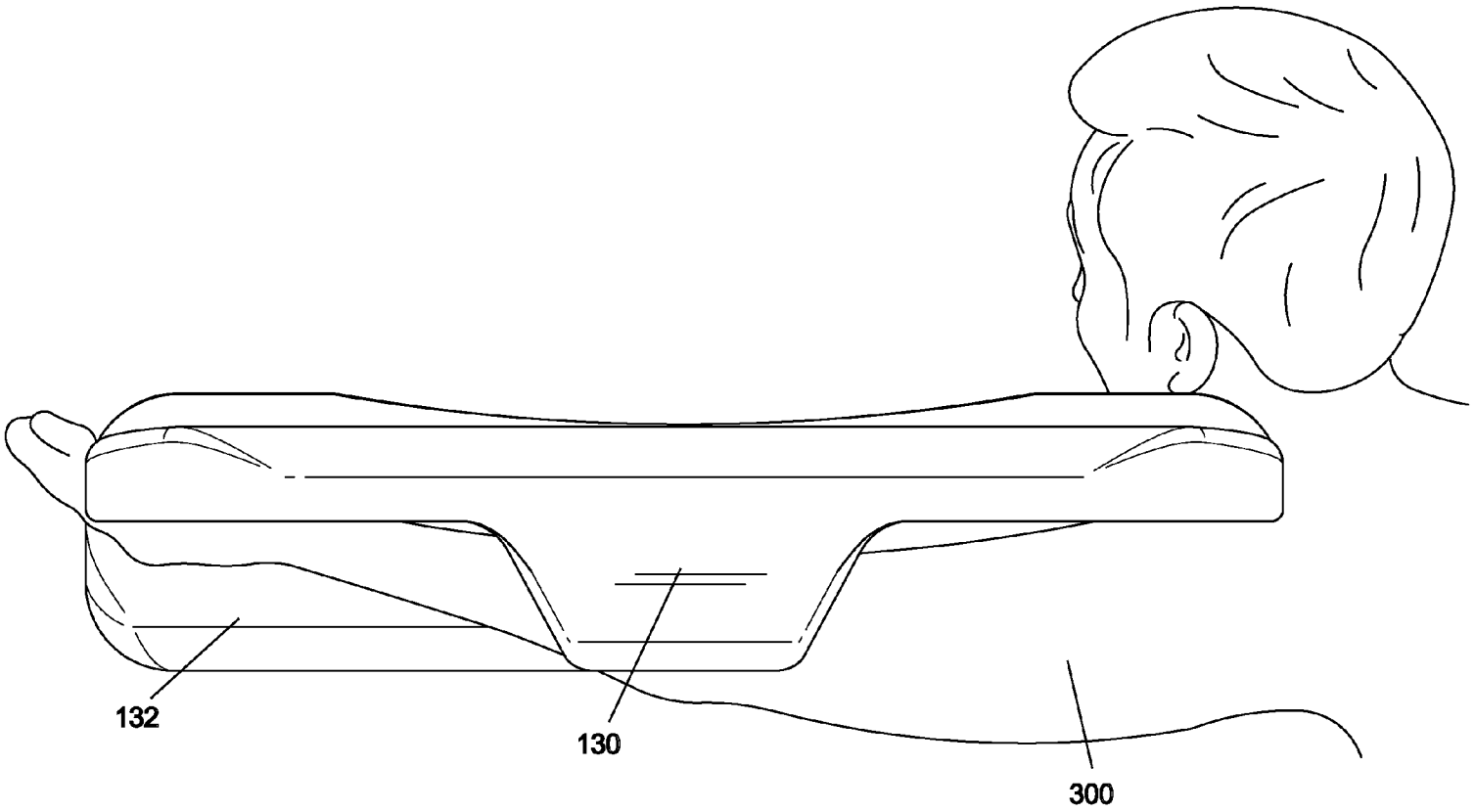
FIGS. 11, 11A, and 11B show a person placing their arm beneath a pillow of the disclosed technology, and a method of pushing one's arm into the cavity beneath the pillow, in embodiments of the disclosed technology.
Figure 11A:
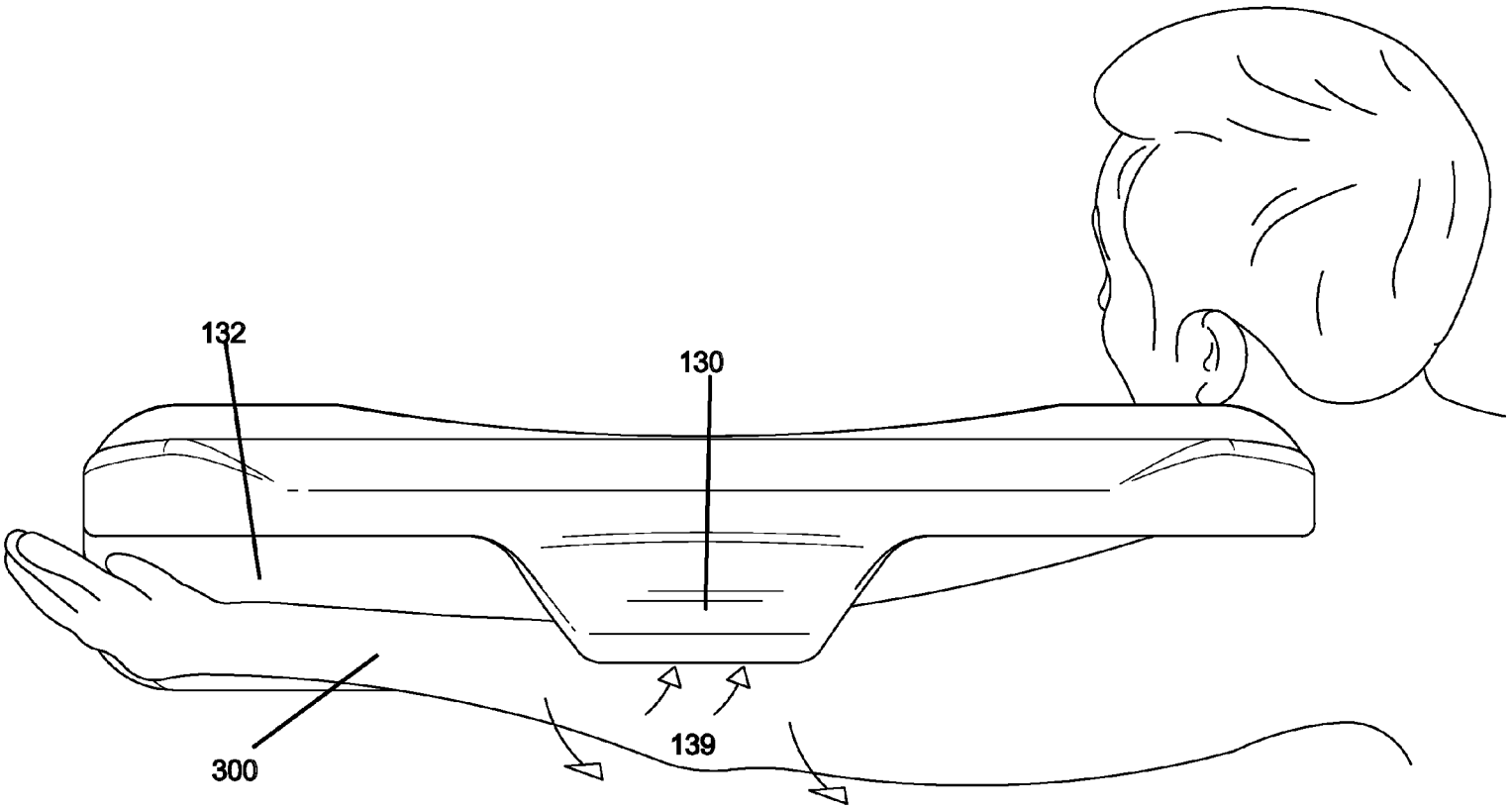
Figure 11B:
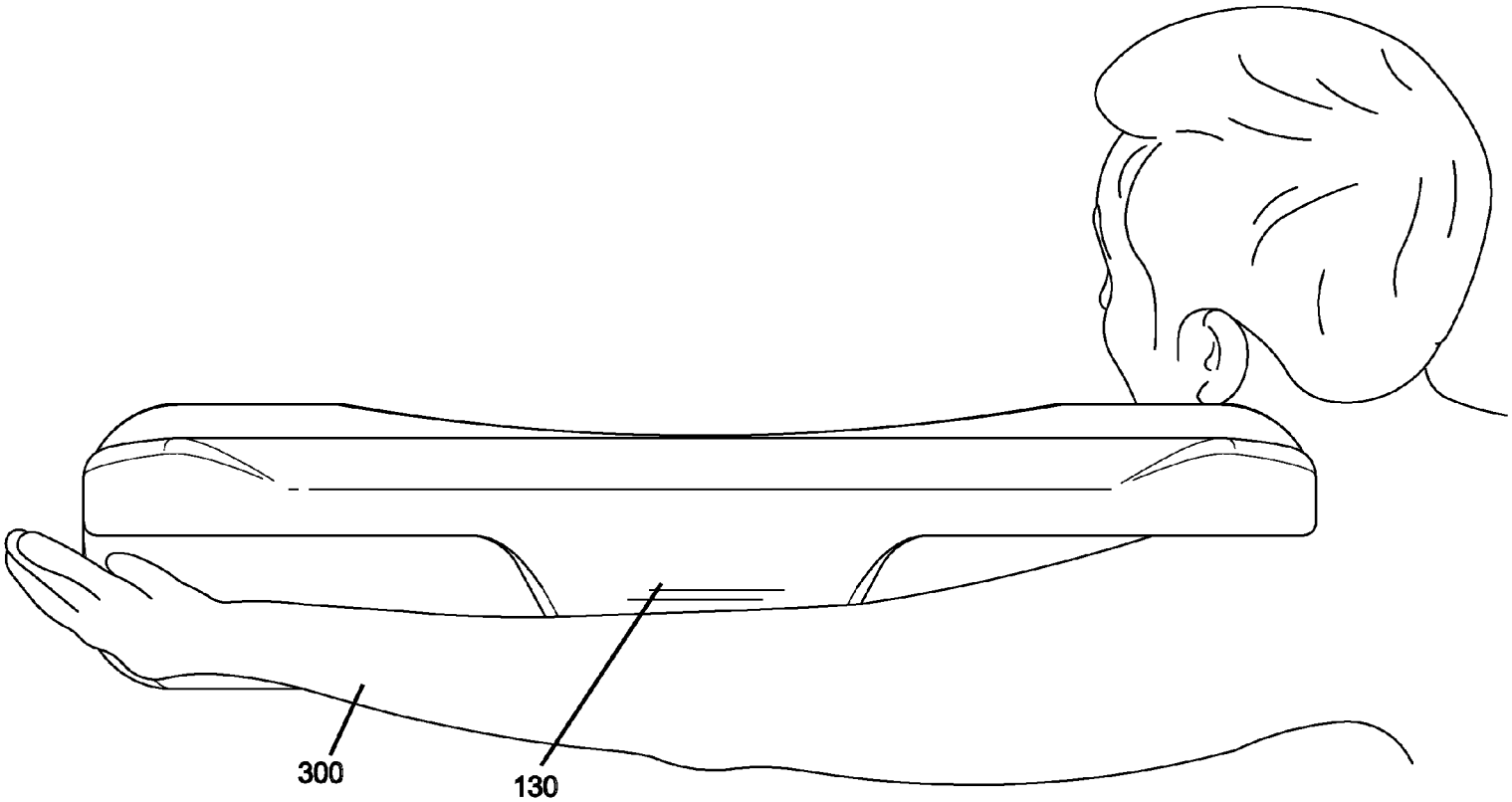
Figure 12:
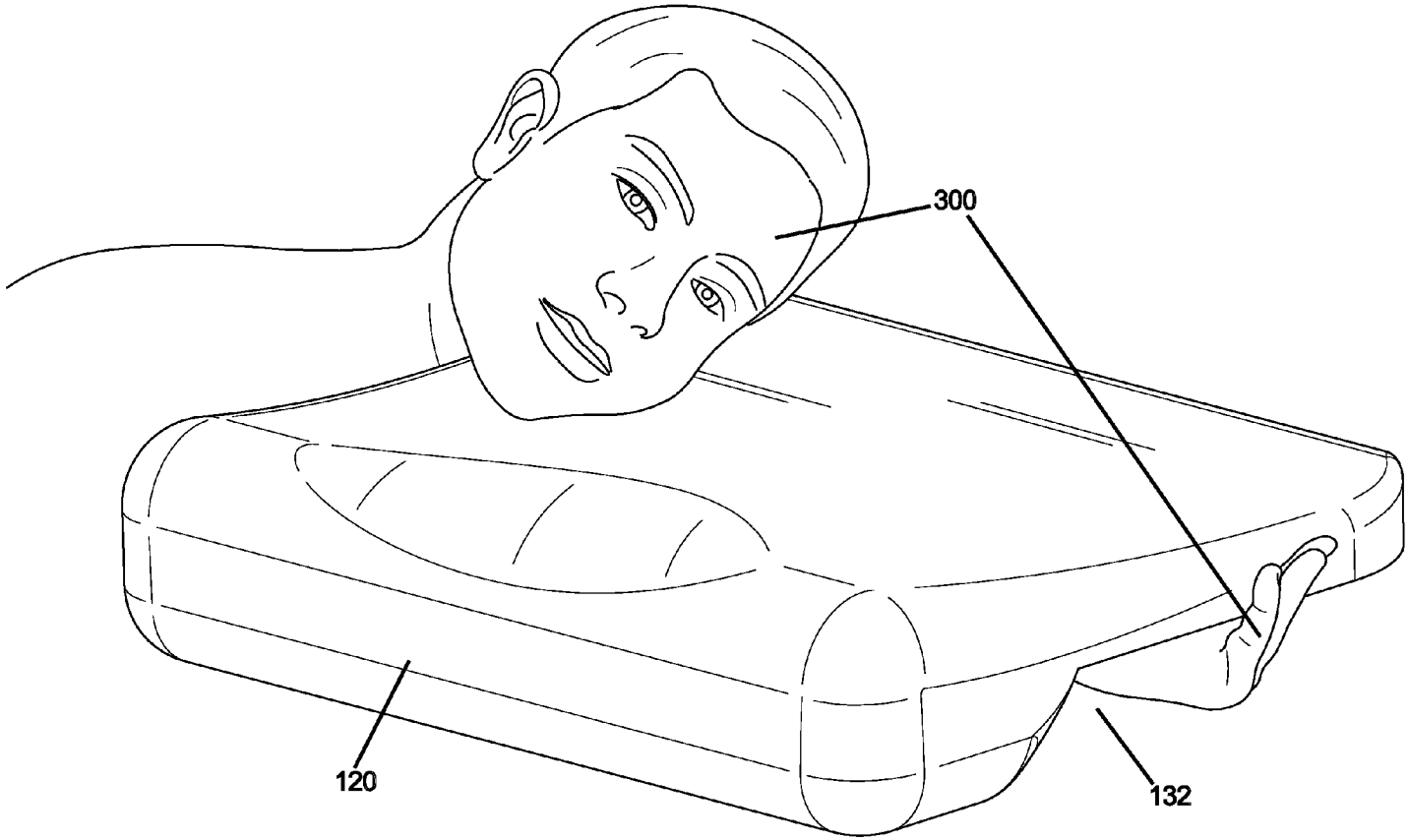
FIG. 12 shows a top perspective view of a person with their arm under the pillow. Again, the head of the person 300 is seen resting on the pillow.

FIGS. 11, 11A, and 11B show a person placing their arm beneath a pillow of the disclosed technology, and a method of pushing one's arm into the cavity beneath the pillow, in embodiments of the disclosed technology. Here, one's head may rest on top of the pillow where they place their arm there-under (as shown in FIG. 11) or on an adjacent pillow. The back support post 130 keeps the top of the pillow off the ground, but also, is a path of entry for the arm. That is, referring now to FIG. 11A in specific, one may push the support post 130 in the direction 139, up from the ground and angled towards the top of the pillow, and slide one's arm under the pillow (into the cavity 132) or out therefrom. In FIG. 11B, one's arm is outside the pillow, and then, by way of pushing past the post 130, one moves their arm underneath, and into the cavity. FIG. 12 shows a top perspective view of a person with their arm under the pillow. Again, the head of the person 300 is seen resting on the pillow.

Figure 13:
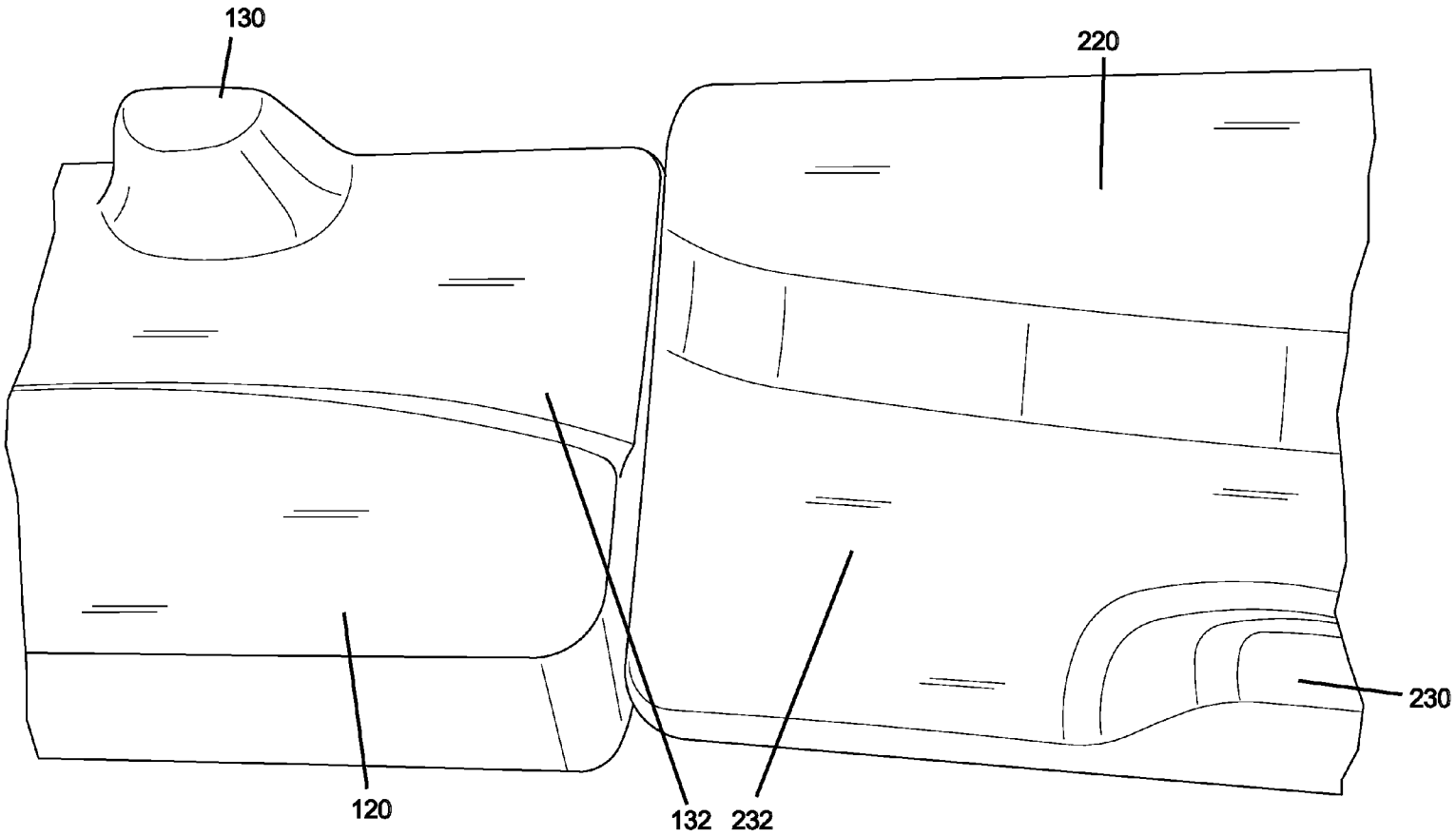
FIG. 13 shows a bottom view of two pillows arranged in opposite orientations.

FIG. 13 shows a bottom view of two pillows arranged in opposite orientations. Here, the posts 130 and 230 are on opposite sides, but the portals or cavities 132 and 232 still line up, to create an extended portal between the two pillows, in a continuous manner via abutment, or adjacent placement (up to 9 inches apart of the sides of each pillow, including 1 inch, 2 inches, 3 inches, and 6 inches) of the pillows to form the continuous cavity. By placing the posts 130 and 230 on transverse sides, a person can angle their arm through the joint cavity 132/232, under their pillow (the pillow with their head there-on) and then under the pillow of their partner.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

The invention claimed is:

1. A pillow having a front side, a back side, a left side and a right side, each said side defining a peripheral edge, the left side and the right side extending generally between the front side and the back side, said pillow comprising:

a top portion adapted for receiving a user's head;

a front support portion and a back support portion adapted to support said top portion on a surface; and a passageway defined beneath said top portion between said front support portion and said back support portion, said passageway being open along a portion of the back side and a portion of the left side and the right side, wherein the pillow includes back corners defined at the intersection of the back side and the respective left side and right side, said passageway being open at said back corners to permit a user's arm to extend longitudinally or diagonally through said passageway.

2. The pillow of claim 1, wherein said back support portion is centered between the left side and the right side.

3. The pillow of claim 1, wherein said front support portion extends fully between the left side and the right side of the pillow.

4. The pillow of claim 1, wherein said back support portion extends partly between the left side and the right side of the pillow.

5. The pillow of claim 1, wherein the pillow is formed as a unitary structure.

6. The pillow of claim 1, wherein said passageway is open along said back side between said back support portion and said respective left side and right side.

7. The pillow of claim 1, wherein said passageway is open along the left side and the right side between said front support portion and said back support portion.

8. The pillow of claim 1, wherein said passageway is continuously open along a portion of the back side and a portion of the left side and the right side.

9. The pillow of claim 1, wherein said front support portion extends from between 10% to 40% of the distance between the front side and the back side of the pillow.

10. The pillow of claim 1, wherein said front support portion extends generally one-third of the distance between the front side and the back side of the pillow.

11. The pillow of claim 1, wherein said passageway extends from between 40% to 90% of the distance between the front side and the back side of the pillow, excluding the back support portion.

12. The pillow of claim 1, wherein said passageway extends generally two-thirds of the distance between the front side and the back side of the pillow, excluding the back support portion.

* * * * *